US007325376B1

(12) United States Patent
DiNello et al.

(10) Patent No.: US 7,325,376 B1
(45) Date of Patent: Feb. 5, 2008

(54) APPARATUS AND METHOD FOR WRAPPING BULK PRODUCTS

(75) Inventors: Anthony V. DiNello, Lockport, IL (US); Christopher D. Ramsey, Chicago, IL (US)

(73) Assignee: FKI Logistex Inc., St. Peters, MO (US)

( * ) Notice: Subject to any disclaimer, the term of this patent is extended or adjusted under 35 U.S.C. 154(b) by 0 days.

(21) Appl. No.: 11/238,712

(22) Filed: Sep. 29, 2005

Related U.S. Application Data

(60) Provisional application No. 60/614,116, filed on Sep. 29, 2004.

(51) Int. Cl.
*B65B 13/02* (2006.01)

(52) U.S. Cl. ..... 53/399; 53/415; 53/135.1; 100/3

(58) Field of Classification Search ..... 53/415, 53/399, 135.1, 589, 586; 100/2, 3, 33 PB; 206/494, 499, 214
See application file for complete search history.

(56) References Cited

U.S. PATENT DOCUMENTS

| | | | | | |
|---|---|---|---|---|---|
| 292,196 | A | * | 1/1884 | Ayer | 40/653 |
| 1,793,328 | A | * | 2/1931 | La Bombard et al. | 24/17 R |
| 2,762,066 | A | * | 9/1956 | Meyer | 412/4 |
| 3,030,750 | A | * | 4/1962 | Lowe et al. | 53/528 |
| 3,256,029 | A | * | 6/1966 | Groom, IV | 281/21.1 |
| 3,407,562 | A | * | 10/1968 | Di Nicola | 53/436 |
| 3,987,901 | A | * | 10/1976 | Dullinger | 206/451 |
| 4,627,219 | A | * | 12/1986 | Omori | 53/399 |
| 4,685,993 | A | * | 8/1987 | Flaherty et al. | 156/475 |
| 5,022,316 | A | * | 6/1991 | Hellwig | 100/34 |
| 5,087,306 | A | * | 2/1992 | Cheung et al. | 156/73.5 |
| 5,214,901 | A | * | 6/1993 | Milliner | 53/397 |
| 5,233,380 | A | * | 8/1993 | Marvy | 396/526 |
| 5,294,100 | A | * | 3/1994 | Scheibelhut | 270/58.09 |
| 5,496,599 | A | * | 3/1996 | Schwartz et al. | 428/35.7 |
| 5,735,104 | A | * | 4/1998 | Odenthal | 53/399 |
| 5,747,131 | A | * | 5/1998 | Kreckel | 428/40.1 |
| H1748 | H | * | 9/1998 | Marinelli et al. | 206/83.5 |
| 5,802,612 | A | * | 9/1998 | Hosking | 2/107 |

* cited by examiner

*Primary Examiner*—Rinaldi I. Rada
*Assistant Examiner*—Paul Durand
(74) *Attorney, Agent, or Firm*—Douglas E. Warren

(57) ABSTRACT

An apparatus and method of bundling bulk items, such as for example papers and magazines, that includes applying a double-sided label to the top and bottom of the material stack, compressing the material stack, applying two binding materials around the material stack, and then relieving the compression on the material stack to allow the binding material to maintain the compression on the bundled material. The binding material, including the double-sided label, can be automatically removed from the bundled material by removing the binding material from the stack of materials and vacuuming the binding material away from the stacked material.

16 Claims, 5 Drawing Sheets

APPARATUS AND METHOD FOR WRAPPING BULK PRODUCTS

CROSS-REFERENCE TO RELATED SPECIFICATIONS

This patent application is related to U.S. Provisional Application Ser. No. 60/614,116 filed on Sep. 29, 2004 from which priority is claimed.

STATEMENT REGARDING FEDERALLY SPONSORED RESEARCH OR DEVELOPMENT

Not applicable.

BACKGROUND OF THE INVENTION

This invention relates in general to the bundling of products for shipping convenience and more particularly to an apparatus and method of bundling loose or bulk products, for example magazines, using a wrapping process that includes binding material that is removable without damaging the bulk products.

Plastic strapping and shrink wrapping are currently the industry standard for securing loose stacks of paper products. Plastic strapping includes one or more straps around a bundle that are not usually fixed to the bundle.

In a traditional plastic strapping process, pre-stacked products such as magazines form a loose stack or bundle that are conveyed out of a stacking mechanism and through a strapping machine. With the aid of a photo eye or some sensory trigger, the strapping cycle is initiated when a strap is fed or pushed through an existing track that forms a hoop that encircles the bundle at a diameter larger than the bundle. The end of the strap makes contact with a clamping mechanism and the feed process is reversed to take up the slack in the strap, thereby liberating the strap from the track and bringing the strap into contact around the bundle. When the tension on the strap reaches a predetermined value, the strap is heat-sealed to the clamped end and then the strap is cut. It is noted that in this traditional plastic strapping process, there is no direct attachment of the strap to the bundle other than the friction caused by the bundle pushing against the hoop strength of the pre-tensioned strap. Additionally, there is currently no widely used or accepted automatic system for removal of the plastic straps from the bundles. Therefore, the plastic straps must be manually removed and this removal includes cutting and discarding the strap or sliding the strap off the end of the bundle.

While a majority of all bundles today reach their destination after being secured in some fashion by wrapping and or strapping as described above, this type of plastic wrapping has a number of disadvantages. To make a durable bundle that will not become loose during shipment, the strap is often installed around the bundle too tightly, thus causing the bundled products to deform and, in some cases, become damaged such that the bundle cannot be reintroduced into any further automated processes. In fact, the damage can be so great that the bundle must be discarded as a damaged product. When the plastic strap is installed loosely enough to prevent the bundle paper products from being deformed and damaged, the plastic strap is often too loose to allow the bundle to be reliably palletized automatically. Additionally, the loose plastic wrapping also makes for unstable manually palletized loads that must themselves be wrapped and strapped. Strapping equipment also has a higher incidence of downtime and a shorter mechanical life span that other equipment in printing industry environments. This is a function of the speed per minute that the bundles must be wrapped. To further exacerbate these problems, the plastic straps must be removed manually from the bundles for further automated processing.

In an alternate form of strapping, the material to be shipped is wrapped with a material that shrinks when warmed, thereby securing the wrapping to the material and generating a secured shipping bundle. In this "shrink wrapping" process, pre-stacked products such as magazines, are positioned to form a loose stack or bundle that are then conveyed out of the stacking mechanism. The stacks are widely spaced via some conveyance medium, usually over two successively faster belt conveyors. The stacks are conveyed without stopping through a machine that has two rolls of film—one over and one under the product. The two rolls of film are joined and cut by a heated wand that melts the two lengths of film together. As the stack moves past the joined rolls, it takes the film with it, both over and under the bundle. When the stack has passed the heated cut-off wand, the two layers of film are cut and joined in one process. The film enshrouded stack is then conveyed through a heat tunnel where hot air causes the film to shrink, thus creating tension and holding the bundle together. The bundle is conveyed out of the heat tunnel and cooled in ambient air.

Once the bundle wrapped by the shrink wrapping process has reached its shipping destination, the shrink wrap material must be removed. There is currently no widely used or accepted automatic system for removal of heat shrink film from bundles. Manual removal of the shrink wrap from the bundle includes cutting and discarding the wrap.

Shrink wrapping has some advantages. For example, the film's coefficient of friction against itself is quite good for use in making pallet loads that are more stable. The bundle also becomes stronger than a stack by itself, thus helping to prevent product damage and paper folding. And, as in the previously described strapping process, most of all bundles usually reach their destination when secured in some shrink wrapped fashion.

However, there are also a number of disadvantages associated with shrink wrapping. For example, shrink wrapping equipment includes a high temperature tunnel that is easily misadjusted thereby causing improper wrapping. During the shrink wrapping process, a bundle stopped in the heat tunnel used to heat and shrink the wrapping material can also ruin the bundle due to the heat, or can actually cause the bundle to burst into flames. The shrink wrapping process also requires burning products that give off potentially toxic gasses and can potentially burn the products.

The completion of the shrink wrapping process also requires extensive use of factory floor space because the bundles must be conveyed down a longer out-feed conveyor needed to allow the heated shrink wrap to cool down. If there is a conveying problem that causes the shrink wrapped bundles to touch each other before the shrink wrap has cooled, the hot bundles can stick to each other. Finally, the shrink wrap material must also be removed manually from bundles for further automated processing making the removal of the shrink wrap labor intensive.

The above bundle packaging methods also present other problems. Bundles of bulk paper items must be transportable without falling apart. The above bundle packaging methods may result in bundles that are too loose or too weak, resulting in unstable loads and loosely strapped bundles that fall apart. While the preferred bundle packaging process must not change its contents, the above examples may result in products damages by crimped bindings, burns, tears, rolled or bent edges, and football-shaped bundles. The above bundle packaging processes are also excessively labor intensive during the process of removing the wrapping material.

A preferable bundle packaging method would likely have a number of preferable characteristics. For example, bundles should maintain bundle integrity for automatic handling of the bundle, such as palletizing, depalletizing, conveying, and sorting, etc. The bundle packaging material should also be automatically removable and include automatic waste removal. Machinery for applying and removing packaging should be reliable with respect to speed, maintenance, and life expectancy. Finally, the packaging material costs for any new packaging process must not exceed current packaging costs. The above-described packaging methods do not offer all of these advantages.

BRIEF DESCRIPTION OF THE SEVERAL VIEWS OF THE DRAWINGS

In the accompanying drawings which form part of the specification and wherein like numerals and letters refer to like parts wherever they occur.

While the embodiment of the present invention is illustrated in the above-referenced drawings and in the following description, it is understood that the embodiment shown is merely for purpose of illustration and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF ONE EMBODIMENT OF THE PRESENT INVENTION

The Wrapping Process.

Figure 1:
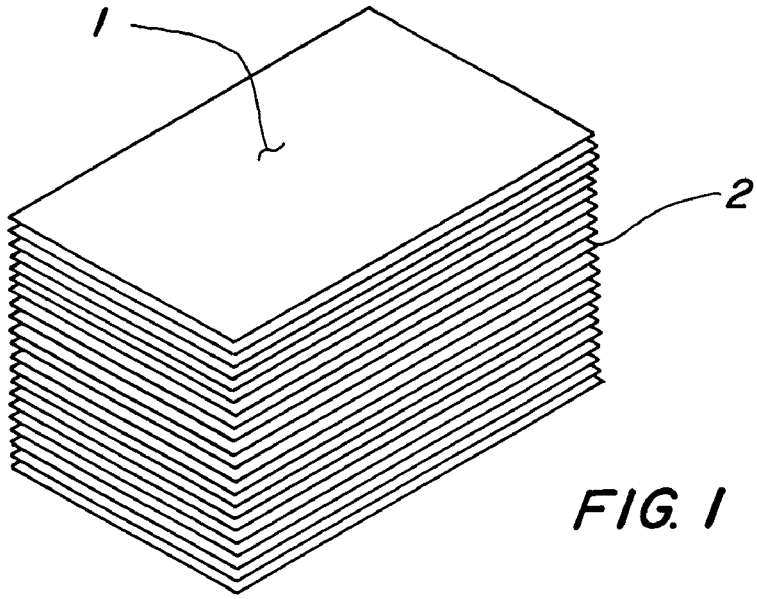
FIG. 1 is a perspective view of one embodiment of the present invention showing A typical bundle to be packaged.
Figure 2:
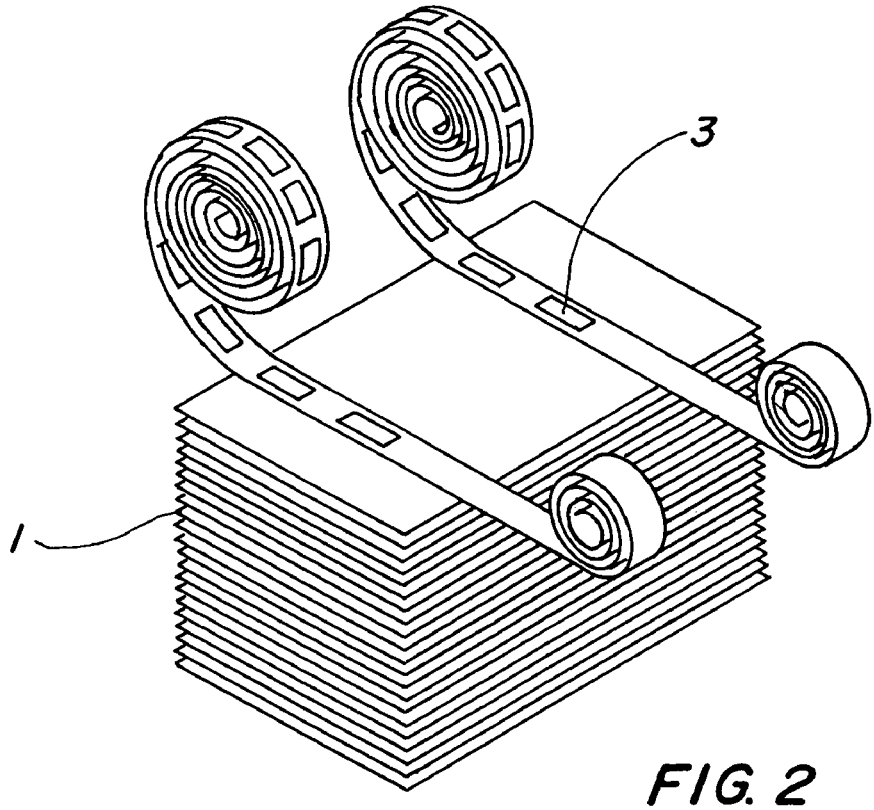
FIG. 2 is a perspective view of one embodiment of the present invention showing the application of special labels to the bundle to be packaged.

Referring to FIG. 1 through FIG. 8, the wrapping process of one embodiment of the present invention is shown. In this embodiment, FIG. 1 shows a 4 inch high stack of standard 8.5 inch×11 inch magazines that represents a material 2 to be packaged in a bundle 1. All magazines are stacked with the bound side to the left of the stack of material 2. The stack of material 2 is generally compressible due to the air entrained between the individual components or magazines being bundled.

The bundle of loose pre-stacked magazines 1, or similar paper products, is conveyed from a stacking mechanism (not shown). The bundle 1 is gapped from any adjacent bundles 1 to allow space between it and the next bundle 1. This spacing is usually accomplished inline by using two speed-up belt conveyors (not shown). In this spacing action, a first conveyor having a set speed transports the bundle onto a second conveyor having a different speed that is greater than the speed of the first conveyor. The speed differential between the first conveyor and the second conveyor causes a bundle that has been placed on the second conveyor to travel faster than the bundle behind that still remains on the first conveyor operating at the slower speed. By the time the next bundle reaches the faster second conveyor, a distance has been generated between the first bundle and the second bundle as both bundles continue on the faster second conveyor.

Figure 3:
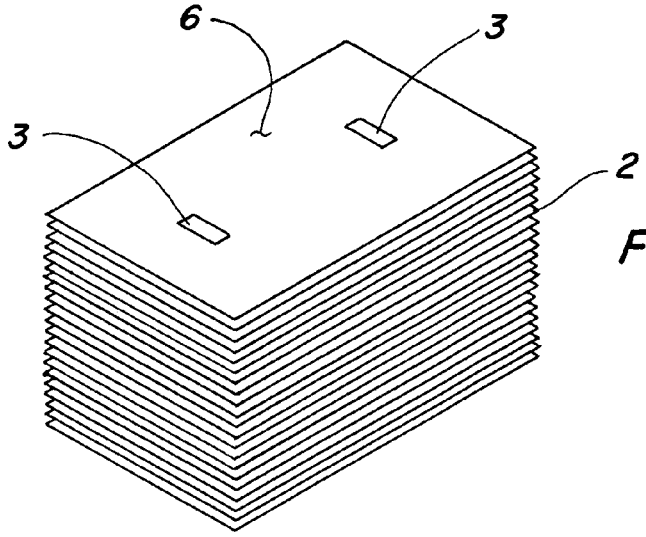
FIG. 3 is a perspective view of one embodiment of the present invention showing the bundle after the special labels have been applied.

Using label applying equipment (not shown), the top surface 6 (FIG. 2) of the bundle 1 receives two double-sided labels 3 having dimensions of about 1.25 inches in width and about 2.50 inches in length. It is understood that the present invention allows adjustments to the length and width of the double-sided label 3 depending upon the specific application and embodiment of the invention. In the current embodiment, the application of the double-sided label 3 is accomplished while the bundle 1 is still moving on the conveyor. It will be appreciated that in other embodiments, the bundle 1 may be stopped or slowed down while the double-sided label 3 is being applied to the top and bottom of the bundle 1. The double-sided label 3 being applied in the current embodiment has a "post it notes/removable tape" type adhesive on one side and a "stickier packing tape/glue" on the other side. As shown in FIG. 3, the bundle 1 is discharged from the label applying equipment with the stickier packing tape side facing up on the bundle 1.

The double-sided label 3 could be the entire width of the binding material to be used. In the present embodiment, the width of the binding material is about 1.25 inches, and it is preferred that the glue surface should be not less that 2.50 inches in the other dimension, and it is preferable that there be some glueless overhang in that dimension of about 0.12 inch. In the present embodiment, the double-sided label 3 could be made from any material that meets the requirements described herein, but its size should preferably be about 2.5 inch×about 1.25 inch.

One purpose of the double-sided label 3 is to anchor the binding material to the top magazine cover so that the binding material can be held in tension along its entire width. The double-sided label 3 does this by transferring forces in the binding material to the front page of the top magazine and into that magazine's binding, thus making the top magazine part of the packaging. This works best in the center at the top and bottom of the cover as you hold the magazine as if it was being opened by a reader, and about 1 inch in from the edge.

In the present embodiment, the double-sided label 3 also offers a number of favorable characteristics. For example, the use of two kinds of glue on this label sized object—permanent on one side and removable on the side facing the stack—allows the stronger glue to be used for permanently adhering the binding material to the label. It is also noted that in the present embodiment, it is preferred that the stronger glue be a strong pressure sensitive glue that has excellent lateral load or shear strength characteristics and covers the whole double-sided label 3. For example, when the preferred glue is stuck to the binding material, the binding material will not slip under the loads that are put on the binding material.

The binding material 10 will be pressed onto this label once by the binding material head, while the weaker side of the double-sided label 3 will adhere to the printed cover of the top magazine. Due to the removable nature of the side of the binding material 10 attached to the magazines in the bundle 1, the double-sided label 3 will not leave a tear or mar the surface when the double-sided label 3 is removed. This weaker glue will be similar to a "post it note/removable tape." The weaker glue should have as much shear strength as possible to keep it from slipping along the paper under tension while simultaneously having a tear strength just below that of the material it is making contact with which, for this embodiment, is a magazine cover. It is also noted that the weaker glue that is on this double-sided label 3 may not cover its entire area.

Figure 4:
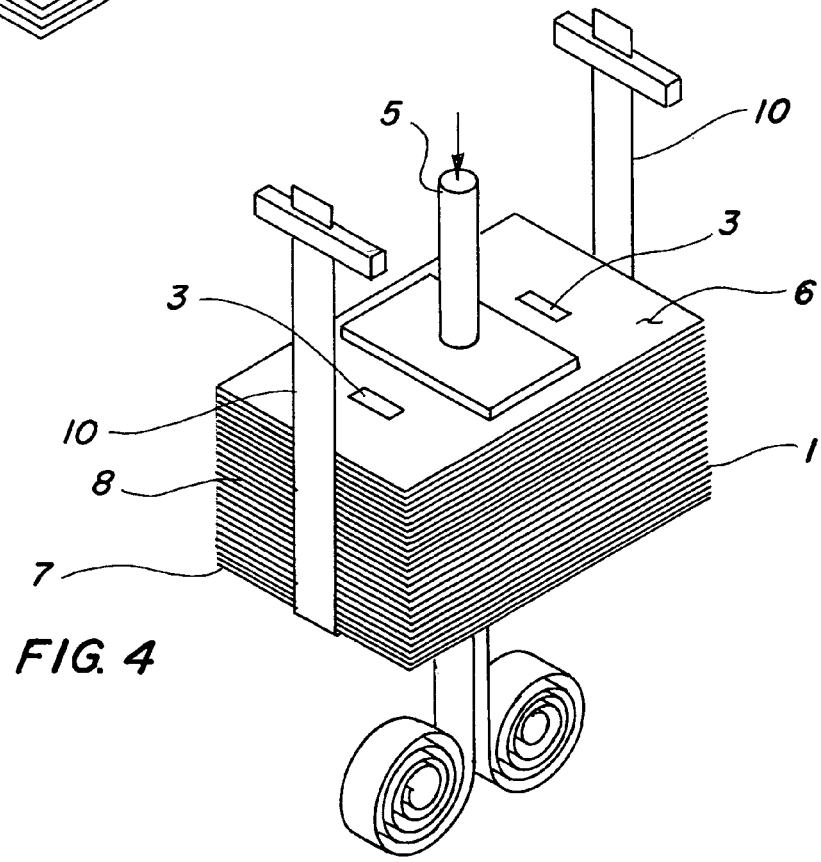
FIG. 4 is a perspective view of one embodiment of the present invention showing the bundle in the first stages of being compressed.

FIG. 4 shows the bundle 1 as it enters a taping machine with the bundle 11.0 inch length perpendicular to flow. In other embodiments the orientation of the individual components of the stack may be in any orientation. In present embodiment, two binding material heads 4 are mounted directly above and below the bundle 1, one on either side. The binding material heads 4 have a cut system similar to the shrink tunnel film applicator described above. The result is that the bundle 1 is moving downward onto one single piece of binding material 10. The compression device 5 is activated to compress the material 2 in the bundle 1 to remove the air entrained between the individual components of the bundle 1.

Figure 5:
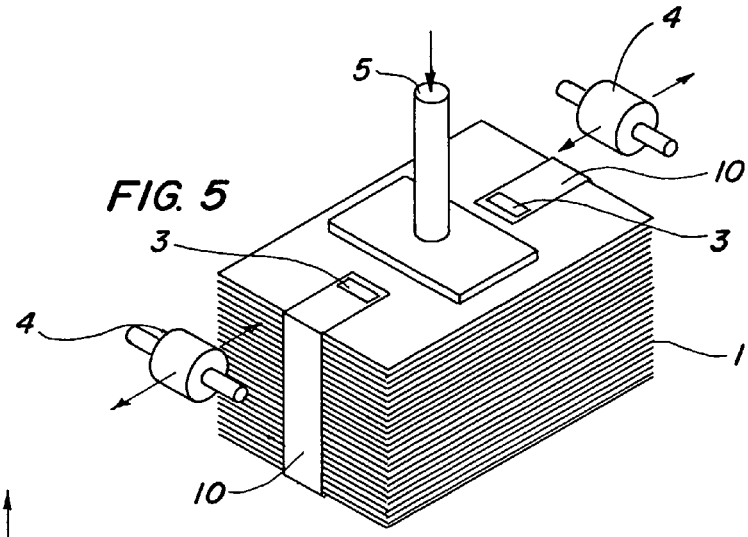
FIG. 5 is a perspective view of one embodiment of the present invention showing the motion of the binding material heads as the they roll the binding material onto the labels.

As the components 2 in the bundle 1 move downward, the two binding material heads 4 contacts the bottom surface 7 of the bundle 1 as shown in FIG. 5. As the bundle 1 passes the two binding material heads 4, the binding material 10 is dispensed up the sides 8 of the bundle 1 and around to the top surface 6 of the bundle 1 where the binding material 10 makes contact with the double-sided label 3. The two binding material heads 4 move together to bind the binding material 10 to label 3 and cuts the binding material 10 for the next bundle 1. The binding material 10 is cut several inches longer than the double-sided label 3 to leave excess loose material in two places on the top surface 6 of the bundle 1.

Figure 6:
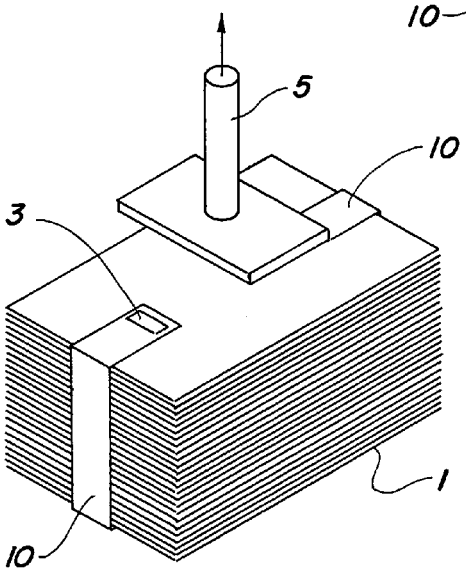
FIG. 6 is a perspective view of one embodiment of the present invention showing the compression device being removed from the packaged bundle.
Figure 7:
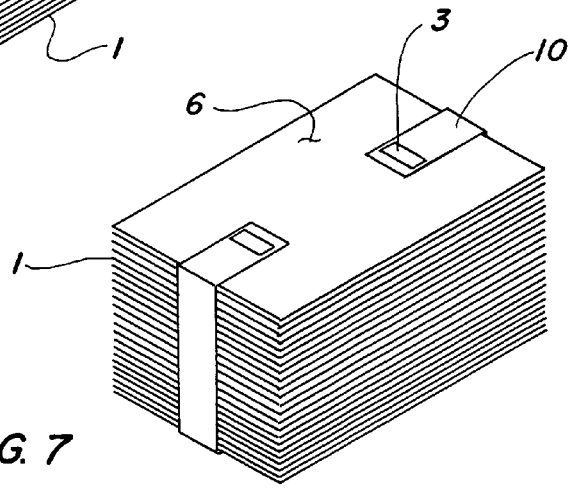
FIG. 7 is a perspective view of one embodiment of the present invention showing the final stage of the bundle after packaging is complete.
Figure 8:
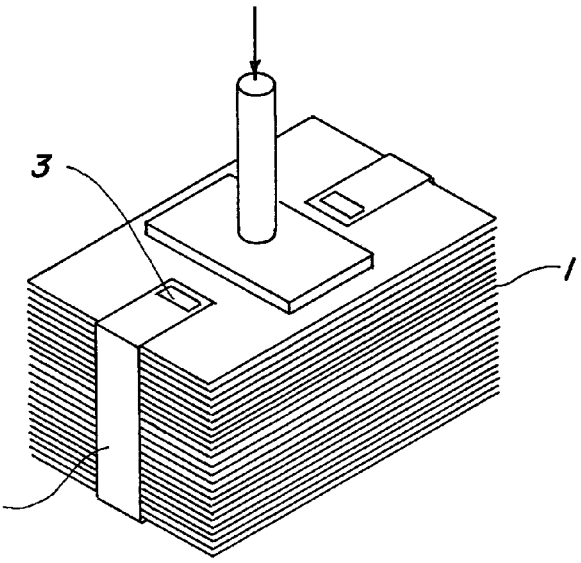
FIG. 8 is a perspective view of one embodiment of the present invention showing the action of the compression device before the binding material is removed.

It is appreciated that the application of the binding material 10 occurs while the material 2 in the bundle 1 is in compression from the compressing device 5. When the binding material 10 has been attached to the double-sided label 3, the compression device 5 is removed from the bundle 1 as shown in FIG. 6. As seen in FIG. 7, the bundle 1 is now wrapped and ready for shipment. The bundle 1 then exits the taping area with one piece of binding material 10 on it. It is understood that each end of the binding material 10 is anchored at the top and bottom at opposite ends of the bundle 1 by the double-sided label 3. In this embodiment of the present invention, the width of the binding material 10 should be at least 30% the width of the dimension that it is wrapping. For example, an 8.5 inch wide stack should be wrapped with a binding material having at least a 2.5 inches width.

In this embodiment of the present invention, the length of a piece of binding material 10 is about twice the height of the bundle 1 plus two extra lengths of about 2 inches on the top surface 6 and about 2.00 inches of the bottom surface 7 of the stack. It will be appreciated by those skilled in the art, that the length of the binding material can be adjusted as need for each unique application while still remaining within the intended scope of the present invention. In a preferred embodiment, the total required length of the binding material 10 for a single bundle 1 in most applications can be calculated via the following:

(2)sides×[height(2)+2.00 inches on top+2.00 inches on bottom]=Length of Overall Binding Material/Bundle.

It has been found that the bundled material has greater stability when the ratio between the dimension of the material being bundled and the width of the binding material is small. For example, a wider binding material results in a more stable bundle. Using the narrowest dimension of the stack of magazines used in the present embodiment, that is, 8.5 inches, the binding material can cover 30% of the width with about a 2.5 inches wide band, whereas, a 3.3 inches wide binding material would be needed to do the same job on the other dimension of 11 inch. For this reason, and in light of the need to stay away from the binding edge of the magazines, the magazines in the present embodiment are wrapped by locating the strapping material along the long 11 inch dimension of the magazine. Additionally, locating the strapping material near the center of the bundle generally works better because this central location minimizes the unbound distance.

The tension in the present embodiment of the invention is introduced evenly through compression of the bundle 1. This is beneficial in that resistance to slippage between the individual items in the bundle 1 increases dramatically when the excess air is gone from the bundle 1. It is also appreciated that it is harder to damage materials through evenly distributed compression rather than point loaded compression in a strapping machine. This means compression can be reached quickly during the packaging process, without damaging the stack material 2 in the bundle 1. The binding material 10 is then wrapping around the stack under enough tension to remove any slack from the binding material. The holding forces that keep the bundled stack together generally come from the expansion of the stack of material 2 when the compression device 5 is removed.

With the combination of the binding material 10 in tension that is wrapped around all four sides and anchored to the top and bottom of the magazine, a stable structure is created that resists torsion in the stack, fanning of the stack rotationally and horizontally, individual magazine slippage pop outs, and bowing of the stack into a shape similar to a football.

The above described embodiment of the present invention offers a number of desirable characteristics including using a strap made of any material that does not stretch under the loads that it will experience and is thin enough to transfer tension around the four trimmed edge corners of the magazine stack it is wrapping. Additionally, the binding material does not have any glue or tack to it.

After the binding material 10 has been applied to the bundle 1, the bundle 1 then leaves the machine and proceeds to a standard palletizer to further prepare for shipment.

The Unwrapping Process.

While the above process may be used where any bundle of loose bulk components must be packaged, other embodiments of the present invention also include additional processing steps for unwrapping the bundle 1. In yet other embodiments of the present invention, only the unwrapping process described herein are included. In fact, it is understood by those skilled in the art that the embodiments of the present invention may include (1) only the process of wrapping a bundle of bulk products as described herein, (2) only the process of unwrapping a bundle of bulk products as described herein, or (3) a combination of wrapping and unwrapping a bundle of packaged bulk products as described herein.

Figure 9:
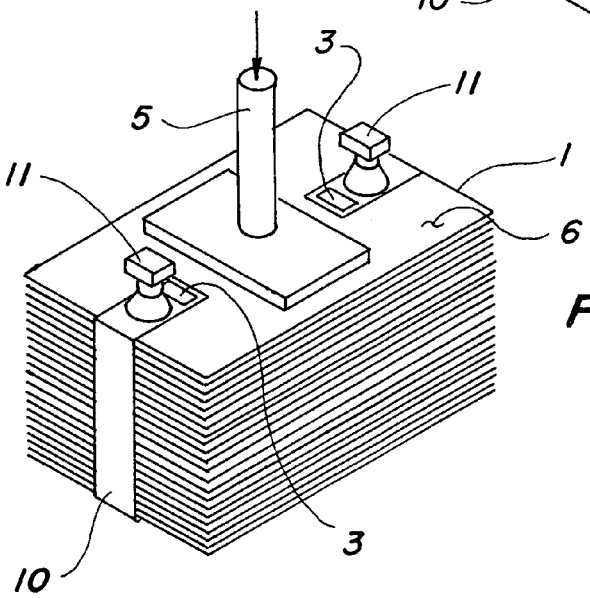
FIG. 9 is a perspective view of one embodiment of the present invention showing the compression device compressing the package and the preliminary locating of the vacuum system onto the binding material.
Figure 10:
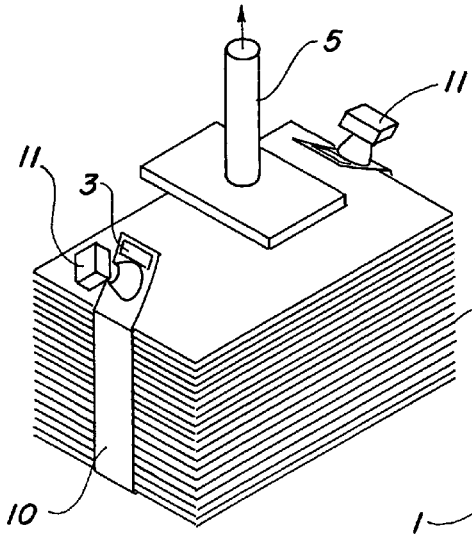
FIG. 10 is a perspective view of one embodiment of the present invention showing the removal of the compression device and the vacuum system removal of the binding material.
Figure 11:
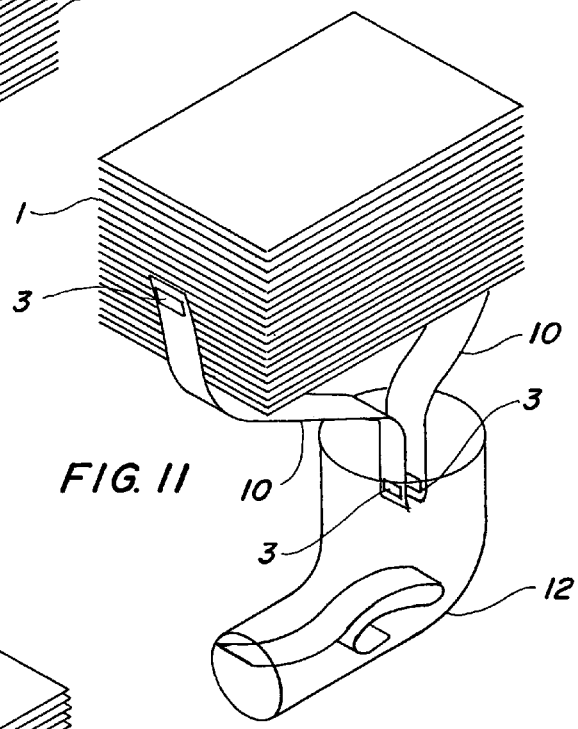
FIG. 11 is a perspective view of one embodiment of the present invention showing the binding material being removed by a vacuum evacuation system.
Figure 12:
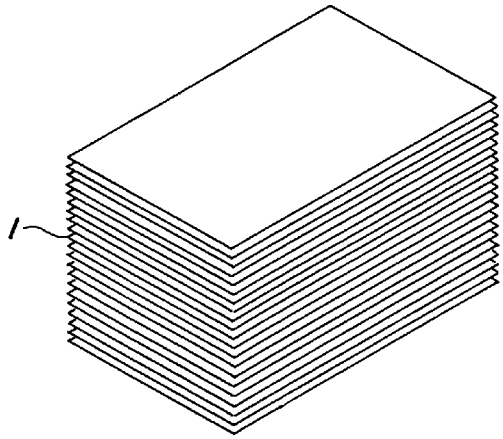
FIG. 12 is a perspective view of one embodiment of the present invention showing the bundle after all packaging material has been removed.

Referring to FIG. 8 through FIG. 12, the unwrapping process of one embodiment of the present invention is shown. Upon reaching its destination, the present embodiment of the invention allows the binding material 10 to be automatically removed from the bundle 1 (FIG. 7). Each bundle 1 can be automatically depalletized and placed onto a conveyor. The bundle 1 is then metered and travels into the binding material 10 removal device where the bundle 1 stops. Compression device 5 (FIG. 8) lowers and makes contact with bundle 1 under light compression to hold and help maintain its structure. A plurality of suction cups 11 above the bundle 1 makes contact with the loose ends of the binding material 10 (FIG. 9). As shown in FIG. 10, the plurality of suction cups 11 in the present embodiment rotate around the bundle 1 while peeling the double-sided label 3 off of the material 2 of the bundle 1. This removes any connection that the bundle 1 has to the binding material 10. A high velocity vacuum system 12 as shown in FIG. 11 opens above or below the bundle 1 where the bundle 1 was and removes the binding material 10. It is understood that the location of the vacuum system can be adjusted while still remaining within the scope of the present invention. It is also understood that other methods may be used to remove the binding material 10 while also remaining within the intended scope of the present invention. The vacuum within the suction cups 11 is stopped and the vacuum suction cups 11 are repositioned to be ready for the next bundle 1 to be unwrapped. As shown in FIG. 12 the bundle 1 becomes a loose bundle and the individual components of the bundle 1 can be removed.

While the above description describes various embodiments of the present invention, it will be clear that the present invention may be otherwise easily adapted to fit any configuration where a process for wrapping and/or unwrapping a bundle is required. As various changes could be made in the above constructions without departing from the scope of the invention, it is intended that all matter contained in the above description or shown in the accompanying drawings shall be interpreted as illustrative and not in a limiting sense. For example, while certain types of manufactures are described herein for the embodiments shown, various other type of manufacturing methods may be used and remain within the scope of the present invention as long as the manufacturing method selected results in the construction of a device that performs the same or similar function as the manufacturing method that is being replaced.

What is claimed is:

1. A process of wrapping bulk material comprising the steps of:

placing at least one attaching element onto a first surface of a bundle of bulk material wherein the at least one attaching element comprises a label having a first surface and a second surface, the first surface having a first adhesive and the second surface having a second adhesive with a different adhesive power than the first adhesive;

wrapping a substantial portion of the bundle of bulk material with a binding;

compressing the bundle of bulk material; and attaching the binding to the at least one attaching element.

2. The process of wrapping bulk material of claim 1 wherein the second adhesive has less adhesive power than the first adhesive.

3. The process of wrapping bulk material of claim 2 wherein the attaching element is attached to the first surface of the bundle of bulk material by placing the second surface substantially in contact with the first surface of the bundle of bulk material.

4. The process of wrapping bulk material of claim 3 wherein the binding is attached to the first surface of the attaching element.

5. The process of wrapping bulk material of claim 4 wherein the first adhesive of the attaching element attaches the binding to the attaching element.

6. The process of wrapping bulk material of claim 5 wherein the binding is pressed onto the first adhesive on the first surface of the attaching element.

7. The process of wrapping bulk material of claim 6 wherein the bundle of bulk material is compressed as the binding is pressed onto the first adhesive on the first surface of the attaching element.

8. The process of wrapping bulk material of claim 7 further comprising the process of unwrapping the bulk material, said unwrapping process comprising the steps of:

placing the wrapped bundle in an unwrapping device capable of removing the binding material from the wrapped bundle;

removing the binding material from the wrapped bundle by using a vacuum device to remove the binding material from the wrapped bundle; and using a vacuum device to relocate the binding away from the bundle.

9. A process of wrapping bulk material comprising the steps of:

placing at least one attaching element onto a first surface of a bundle of bulk material, the attaching element comprising a label having a first surface and a second surface, the first surface having a first adhesive and the second surface having a second adhesive having a different adhesive power than the first adhesive;

compressing the bundle of bulk material;

wrapping a substantial portion of the bundle of bulk material with a binding; and attaching the binding to the at least one attaching element wherein the first adhesive of the attaching element attaches the binding to the attaching element.

10. The process of wrapping bulk material of claim 9 wherein the second adhesive has less adhesive power than the first adhesive.

11. The process of wrapping bulk material of claim 10 wherein the attaching element is attached to the first surface of the bundle of bulk material by placing the second surface substantially in contact with the first surface of the bundle of bulk material.

12. The process of wrapping bulk material of claim 11 wherein the binding is attached to the first adhesive on the first surface of the attaching element.

13. The process of wrapping bulk material of claim 12 wherein the binding is pressed onto the first adhesive on the first surface of the attaching element.

14. The process of wrapping bulk material of claim 13 further comprising the process of unwrapping the bulk material, said unwrapping process comprising the steps of:

placing the wrapped bundle in an unwrapping device capable of removing the binding material from the wrapped bundle;

removing the binding material from the wrapped bundle by using a vacuum device to remove the binding material from the wrapped bundle; and using a vacuum device to relocate the binding away from the bundle.

15. A process of wrapping bulk material comprising the steps of:

stacking a quantity of a bulk paper material to generate a bundle;

applying at least attaching element to a top surface of the bundle, the attaching element comprising a label having a first surface and a second surface, the first surface having a first adhesive and the second surface having a second adhesive having a different adhesive power than the first adhesive;

compressing the bundle by applying a compression device to the bundle;

applying a binding material to the bundle by wrapping the bundle with the binding material and attaching the binding material to the at least one attaching element; and releasing the compression device to release the compression on the bundle.

16. The process of wrapping bulk material of claim 15 further comprising the process of unwrapping the bulk material, said unwrapping process comprising the steps of:

placing the wrapped bundle in an unwrapping device capable of removing the binding material from the wrapped bundle;

removing the binding material from the wrapped bundle by using a vacuum device to remove the binding material from the wrapped bundle; and using a vacuum device to relocate the binding away from the bundle.

* * * * *